US007857497B2

(12) United States Patent
Koike et al.

(10) Patent No.: US 7,857,497 B2
(45) Date of Patent: Dec. 28, 2010

(54) LED LIGHTING FIXTURE

(75) Inventors: Teruo Koike, Tokyo (JP); Shoichi Bamba, Tokyo (JP); Ryotaro Owada, Tokyo (JP); Hidetaka Okada, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 474 days.

(21) Appl. No.: 11/925,054

(22) Filed: Oct. 26, 2007

(65) Prior Publication Data

US 2008/0101063 A1 May 1, 2008

(30) Foreign Application Priority Data

Oct. 27, 2006 (JP) ..... 2006-292672

(51) Int. Cl.
*F21S 8/10* (2006.01)

(52) U.S. Cl. ..... 362/545; 362/234; 362/235; 362/242; 362/311.02; 362/335

(58) Field of Classification Search ..... 362/545, 362/234, 235, 236, 242, 243–246, 311.02, 362/335

See application file for complete search history.

(56) References Cited

U.S. PATENT DOCUMENTS

| | | | | |
|---|---|---|---|---|
| 6,250,774 | B1 * | 6/2001 | Begemann et al. | 362/231 |
| 6,364,514 | B1 | 4/2002 | Natsume | |
| 6,575,582 | B2 | 6/2003 | Tenmyo | |
| 6,773,139 | B2 * | 8/2004 | Sommers | 362/237 |
| 6,951,416 | B2 | 10/2005 | Sazuka et al. | |
| 7,618,162 | B1 * | 11/2009 | Parkyn et al. | 362/335 |
| 2003/0053310 | A1 | 3/2003 | Sommers | |
| 2005/0270792 | A1 | 12/2005 | Suzuki | |
| 2006/0083002 | A1 | 4/2006 | Koike et al. | |

FOREIGN PATENT DOCUMENTS

| | | |
|---|---|---|
| EP | 1418381 | 5/2004 |
| JP | 2004087179 | 3/2004 |
| JP | 2004200102 | 7/2004 |

OTHER PUBLICATIONS

European Search Report for EP Patent App. No. 07020921.8 (Feb. 18, 2008).

* cited by examiner

*Primary Examiner*—Sandra L O Shea
*Assistant Examiner*—Jessica L McMillan
(74) *Attorney, Agent, or Firm*—Kenealy Vaidya LLP

(57) ABSTRACT

An LED lighting fixture is provided which achieves effective use of light, uniformly illuminates a large area and, has a high degree of freedom in designing light distribution characteristics. Three types of LED optical modules are used each having different light distribution characteristics. Each LED optical module includes an LED light source and a light distribution controlling lens of a different shape which constitute an optical system. Three types of LED optical units having different light distribution characteristics can be used. Each LED optical unit includes a set of LED optical modules having the same light distribution characteristics. The LED lighting fixture is configured to have a combination of the LED optical units having different light distribution characteristics.

18 Claims, 15 Drawing Sheets

LED LIGHTING FIXTURE

This application claims the priority benefit under 35 U.S.C. §119 of Japanese Patent Application No. 2006-292672 filed on Oct. 27, 2006, which is hereby incorporated in its entirety by reference.

BACKGROUND

1. Technical Field

The presently disclosed subject matter relates to an LED lighting fixture, and in particular, to an LED lighting fixture for outdoor use that uses LED light sources.

2. Description of the Related Art

Traditionally, lighting fixtures such as incandescent, fluorescent or mercury lighting fixtures are used on roads, parks and other outdoor spaces. These lights are designed to illuminate wide areas and are generally placed high above the ground. The maintenance cost of these lighting fixtures is generally high because they not only use high power incandescent lamps, fluorescent lamps or mercury lamps as their light source, but also require frequent replacement, resulting in additional costs associated with parts and labor.

To decrease the maintenance cost, lighting fixtures using LED light sources have been proposed. As shown in FIG. 1, such a lighting fixture typically includes a plurality of printed boards each arranged to form a part of a "polygon." Each single printed board includes a plurality of white LEDs mounted on it, all of which has the same directivity.

Each printed board includes a particular number of LEDs each having a particular directivity so that the LEDs can illuminate a desired area at a desired intensity in a specific direction (see, for example, Japanese Patent Application Laid-Open No. 2004-200102).

The lighting fixture described in Japanese Patent Application Laid-Open No. 2004-200102 ensures a wide illumination area in the horizontal direction with respect to the lighting fixture (or the direction along which the printed boards are arranged) since all of the LEDs mounted on the particular printed board point to that direction. However, it can achieve only a narrow illumination area in the direction perpendicular with respect to the lighting fixture (or the vertical direction with respect to the cross section shown in FIG. 1) since all of the LEDs mounted on a particular printed board are directed at the same angle to that direction and, thus, the illumination area in that direction is determined almost solely by the directivity of the LEDs. For this reason, the lighting fixture tends to form an illumination pattern that is biased to one direction and cannot distribute light evenly.

SUMMARY

In view of the conventional problems described above as well as other problems and considerations in the art, the presently disclosed subject matter has been devised in light of these considerations and problems. An LED lighting fixture that is efficient, can evenly illuminate a wide area, and can be designed with a high degree of freedom to achieve desired light distribution performance has been sought in the art.

To attempt to address and possibly solve the above-described and other problems and considerations, one aspect of the presently disclosed subject matter can provide an LED lighting fixture. In the LED lighting fixture, an LED optical module can have an optical system composed of an LED serving as a light source and a lens for controlling the distribution of light emitted from the LED light source. One or more of such LED optical modules, each of which has a light distribution controlling lens with the same or substantially the same shape and light distribution characteristics, may be combined to form an LED optical unit. Two or more LED optical modules having light distribution controlling lenses with different shapes and different light distribution characteristics may be combined to form such an LED optical unit. One or more sets of these LED optical units can be combined to make the LED lighting fixture in accordance with the presently disclosed subject matter.

Namely, in accordance with one exemplary embodiment of the presently disclosed subject matter, the LED lighting fixture can include: a set of LED optical units having different light distribution characteristics, each LED optical unit comprising at least one LED optical module for forming corresponding light distribution characteristics, the LED optical module including an LED serving as a light source and a light distribution controlling lens arranged in an illumination direction of the LED light source, wherein the LED optical module(s) mounted to the same LED optical unit are of the same type and whereas the LED optical modules mounted to the different LED optical units are different from each other.

The LED optical units may be configured in such a manner that part of an area to be illuminated by the LED lighting fixture and close to the LED lighting fixture can be illuminated by an LED optical unit having a wide light distribution characteristic, and parts of an area increasingly distant from the lighting fixture can be illuminated by LED optical units having increasingly narrow light distribution characteristic.

The light distribution controlling lens can include an incident surface upon which the light from the LED is incident and a light-emitting surface from which the light is emitted to the outside with the incident surface and the light-emitting surface both being curved in the illumination direction relative to the LED to form a substantially convex profile. Furthermore, the light distribution controlling lens can have a focal point at or in the vicinity of which the LED is placed. The light-emitting surface can comprise a plurality of continuous free curved surfaces differing in shape.

The light-emitting surface of the light distribution controlling lens can have a shape that refracts light in a designated direction in a continuous manner according to an incident angle of the light from the focal point of the light distribution controlling lens.

The LED lighting fixture can include a combination of different types of LED optical units having different light distribution characteristics. Specifically, the LED lighting fixture can be constructed in such a manner that, when it is placed at an angle to the surface to be illuminated, different regions of the surface that are increasingly distant from the lighting fixture are illuminated by LED optical units that are designed to distribute light to increasingly small areas.

According to another aspect of the disclosed subject matter, an LED lighting fixture can include at least one first LED optical unit including at least one first LED optical module configured to emit light forming a first light characteristic, the at least one first LED optical module being located in a first LED optical unit housing, and at least one secondary LED optical unit including at least one secondary LED optical module configured to emit light forming a secondary light characteristic, the secondary light characteristic being different from the first light characteristic, and the at least one secondary LED optical module being located in a secondary LED optical unit housing, wherein the at least one first LED optical module includes a first LED serving as a first light source and includes a first light characteristic controlling lens located in an illumination direction of the first LED light source, and the at least one secondary LED optical module includes a secondary LED serving as a secondary light source and includes a secondary light characteristic controlling lens located in an illumination direction of the secondary LED light source, the secondary light characteristic controlling lens being shaped differently from the first light characteristic controlling lens.

According to yet another aspect of the disclosed subject matter, the at least one first LED optical module can include a plurality of first LED optical modules, and the at least one secondary LED optical module can include a plurality of secondary LED optical modules.

As a result, such LED lighting fixtures can be efficient in terms of light utilization, and can also evenly illuminate a desired area, and can be designed with a high degree of freedom to achieve desired light distribution characteristics.

BRIEF DESCRIPTION OF THE DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

Figure 1:
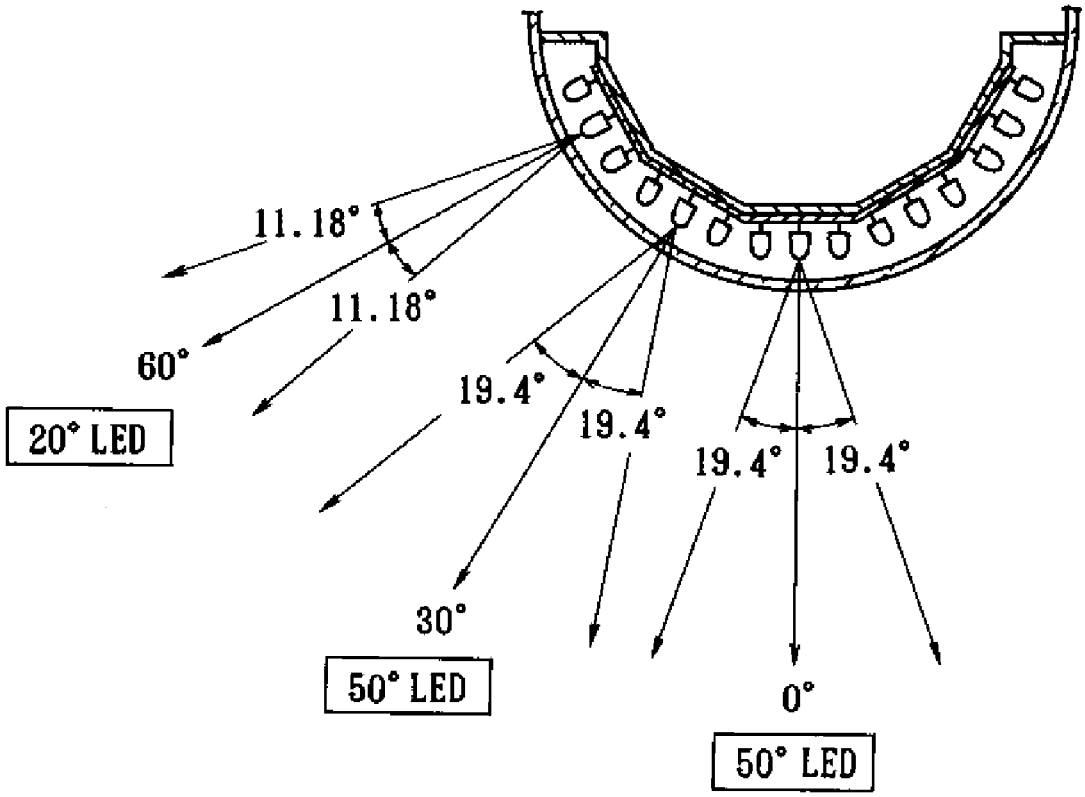
Fig. 1 Conventional Art
FIG. 1 is a cross-sectional view of a conventional lighting unit.

The LED optical module used in the LED lighting fixture made in accordance with principles of the presently disclosed subject matter can include an optical system composed of an LED serving as a light source and a lens for controlling the distribution of light emitted from the LED light source. One or more of such LED optical modules, each of which has a light distribution controlling lens with the same or substantially the same shape and light distribution characteristics, may be combined to form an LED optical unit. Two or more LED optical modules having light distribution controlling lenses with different shapes and different light distribution characteristics may also be combined to form such an LED optical unit. One or more sets of these LED optical units can be combined to make an LED lighting fixture in accordance with principles of the presently disclosed subject matter.

Such an LED lighting fixture can realize a compact body and can control the focusing function and the diffusion function of light, the two major factors that determine the distribution of light, in one body. The LED lighting fixture can also achieve desired light distribution characteristics, as well as desired distribution of illumination.

Several examples of the presently disclosed subject matter will now be described in detail with reference to FIGS. 2 through 24, in which the same reference numerals denote the same or similar elements. It should be appreciated that, while the following examples, which are presented by way of example only, include various technical features, they are not intended to limit the scope of the presently disclosed subject matter.

Figure 2:
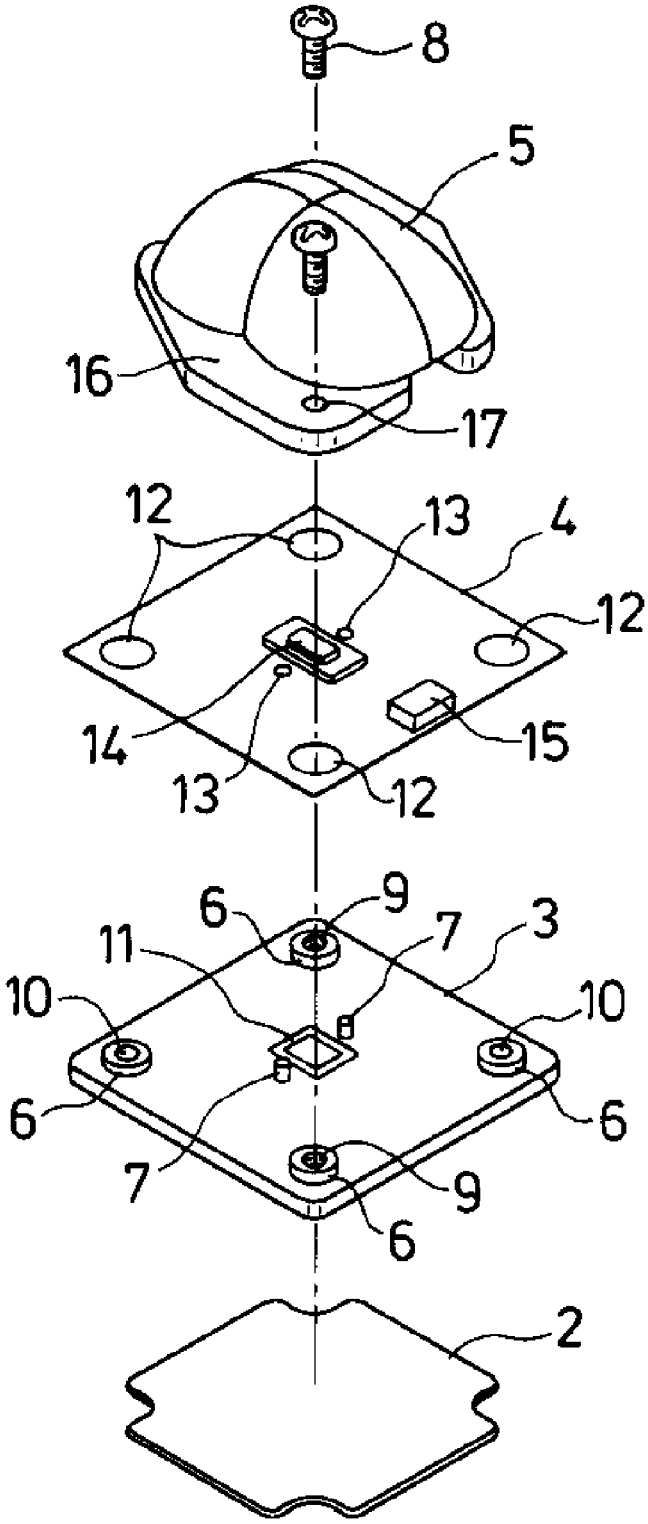
FIG. 2 is an exploded perspective view of an exemplary LED optical module made in accordance with principles of the disclosed subject matter.
Figure 3:
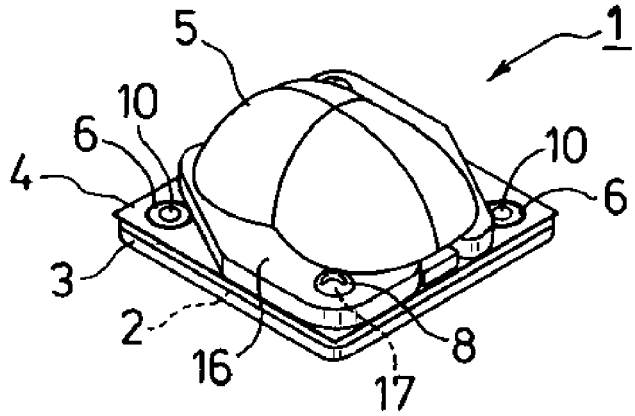
FIG. 3 is a perspective view of the LED optical module of FIG. 2.

FIGS. 2 and 3 are an exploded perspective view and a perspective view of an exemplary LED optical module made in accordance with principles of the presently disclosed subject matter, respectively. The LED optical module 1 includes a heat-conductive sheet 2, a heat-conductive plate 3, a circuit board 4, and a light distribution controlling lens 5 that are stacked from the bottom up.

When the LED optical module 1 is mounted on a housing, the heat-conductive sheet 2 arranged at the bottom can be configured to directly contact the housing and serve to conduct the heat generated by the LED optical module 1 to the housing, preventing the temperature of the LED optical module 1 from rising. This will be described in more detail later. For this reason, the heat-conductive sheet 2 is made of a thermally conductive but electrically insulative material with minimum thermal resistance. The heat-conductive sheet 2 is formed as thin as possible as long as its physical reliability is not lost.

The heat-conductive plate 3 is arranged on top of the heat-conductive sheet 2, and is made of a thermally conductive hard material (including metals, such as aluminum, copper and iron, and ceramics). A set of bosses 6 and boss pins 7, each projecting upward, are arranged on one side of the heat-conductive plate 3 along the periphery and at the center of the plate 3, respectively. Each boss 6 includes either a screw bore 9, or a screw bore 10. The screw bore 9 is used for receiving the shank of an assembly screw 8 that holds together the heat-conductive plate 2, the circuit board 4 and the light distribution controlling lens 5 to assemble the LED optical module 1. The screw bore 10 is used for receiving the shank of a screw that serves to secure a plurality of LED optical modules 1 to form a unit. The screw bores 9 and 10 are each formed through the heat-conductive plate 3.

The heat-conductive plate 3 also includes a groove 11 in the form of a closed loop at the center of the plate on the inside of the boss pins 7. The groove 11 serves to receive an adhesive.

The thin circuit board 4 such as a flexible circuit board is arranged on top of the heat-conductive plate 3. The circuit board 4 includes boss bores 12 and boss pin bores 13 formed at positions corresponding to the bosses 6 and the boss pins 7 on the heat-conductive plate 3 below for receiving the bosses 6 and the boss pins 7, respectively.

The circuit board 4 further includes a window 18 (see FIG. 4 or 5) formed at the center thereof on the inside of the boss pin bores 13. An LED 14 serving as a light source can be mounted on the circuit board 4 to cover the window 18. The electrodes of the LED 14 can be connected to the pad portions of a wiring conductor on the circuit board 4 through a conductive material (such as a solder or a conductive adhesive). The wiring conductor extending from the pad portion runs over the circuit board 4 and is shown in this example as being connected to the electrode terminal of a board connector 15 mounted near the edge of the circuit board 4.

A light distribution controlling lens 5 can be arranged on the circuit board 4. The light distribution controlling lens 5 has a flange 16 and serves to control the distribution of light emitted from the LED 14 below. The flange 16 can include a screw bore 17 for receiving the shank of an assembly screw 8 for assembling the LED optical module.

The above-described heat-conductive plate 3, the circuit board 4, and the light distribution controlling lens 5 are assembled together by the assembly screws 8 to construct the exemplary LED optical module 1, as shown in FIG. 3.

Figure 4:
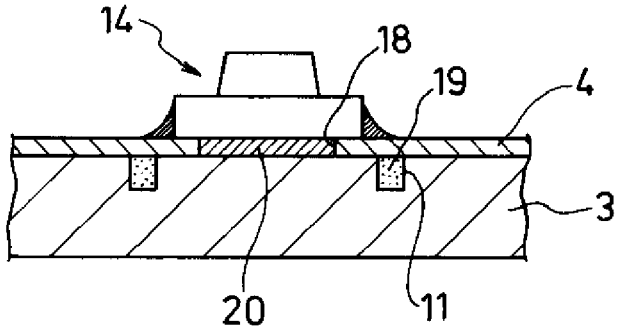
FIG. 4 is a partial cross-sectional view of the LED optical module of FIG. 3.
Figure 5:
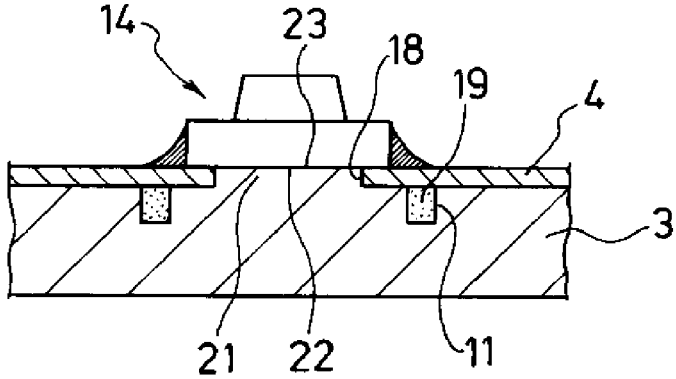
FIG. 5 is a partial cross-sectional view of the LED optical module of FIG. 3.

The adjacent area of the LED 14 may be constructed as shown in FIG. 4 or 5. In the exemplary structure of FIG. 4, the circuit board 4 with the LED 14 mounted thereon to cover the window 18 is placed on the flat surface of the heat-conductive plate 3. The circuit board 4 and, thus, the LED 14 are positioned relative to the heat-conductive plate 3 by means of the boss pins 7 on the heat-conductive plate 3 passing through the boss pin bores 13 formed through the circuit board 4.

The circuit board 4 with the LED 14 mounted thereon is adhered/secured to the heat-conductive plate 3 by an adhesive 19 loaded in the groove 11 formed on the heat-conductive plate 3.

The window 18 of the circuit board 4 is filled with a high heat-conductive compound 20 to thermally connect the LED 14 to the heat-conductive plate 3. This construction allows the heat generated by the LED 14 to effectively escape to the heat-conductive plate 3, thus preventing the temperature of the LED 14 from rising.

In the structure of FIG. 5, the heat-conductive plate 3 includes a raised portion 21 that is smaller in area than the window 18 of the circuit board 4 and has a height substantially the same as the thickness of the circuit board 4, so that the surface 22 of the raised portion 21 of the heat-conductive plate 3 positioned within the window 18 of the circuit board 4 is substantially level with the surface 23 of the circuit board 4 on which to mount the LED 14. In this construction, the LED 14 directly contacts the heat-conductive plate 3, allowing the heat generated by the LED 14 to escape more effectively to the heat-conductive plate 3 as compared to the structure of FIG. 4. As a result, the increase in the temperature of the LED optical module 1 is more effectively prevented.

The height of the raised portion 21 of the heat-conductive plate 3 may be smaller than the thickness of the circuit board 4. In that case, the space formed within the window 18 of the circuit board 4 may be filled with the high heat-conductive compound 20 to thermally connect the LED 14 to the heat-conductive plate 3.

Figure 6:
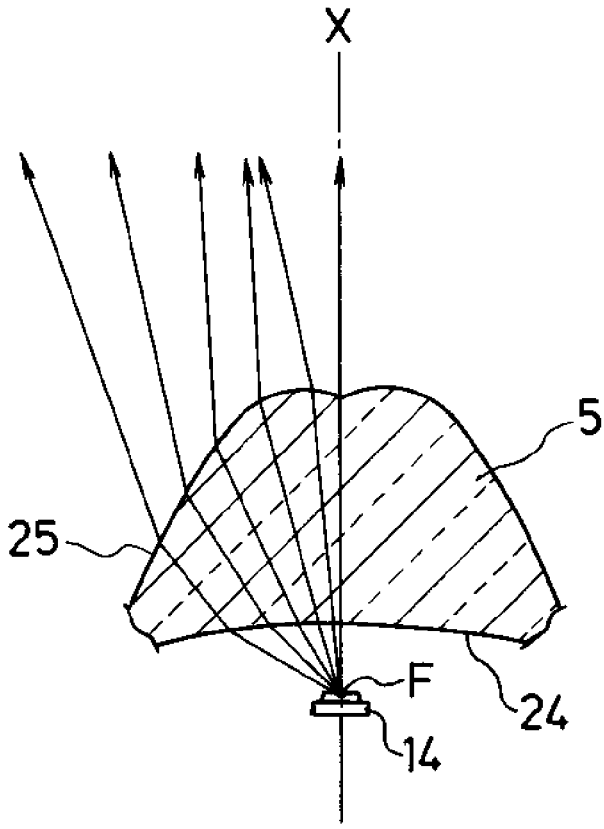
FIG. 6 is an illustrative diagram with cross-sectional view showing an optical system of the LED optical module of FIG. 3.

The optical system of the LED optical module will now be described. FIG. 6 is a schematic cross-sectional view of an exemplary LED light source and a light distribution controlling lens that form the optical system of an LED optical module.

The light distribution controlling lens 5 is positioned about the optical axis X that extends forward from the LED 14. The surface of the light distribution controlling lens 5 facing the LED 14 (light incident surface 24), as well as the opposite surface of the light distribution controlling lens 5 (light-emitting surface 25), is curved forward (relative to the LED 14), forming a substantially convex profile of the lens. In this arrangement, the focal point F of the light incident surface 24 of the light distribution controlling lens 5 is in the proximity of the light-emitting part of the LED 14.

The light radially emitted from the LED 14 and reaching the light incident surface 24 of the light distribution controlling lens 5 enters the light distribution controlling lens 5 from the light incident surface 24 and is guided through the light distribution controlling lens 5 to the light-emitting surface 25, from which it goes out of the light distribution controlling lens 5.

Since the light distribution controlling lens 5 serves to convert the light distribution characteristics of the LED 14 to desired light distribution characteristics, its design is determined as follows.

The area illuminated by a particular LED optical module is divided into a plurality of sections and a desired light distribution characteristic is determined for each section. The shape of the light-emitting surface of the light distribution controlling lens is then determined so that the incident light can be refracted and further be refracted when going out and the lens emits light having the corresponding light distribution characteristics as refracted light.

The shape of the light-emitting surface of the light distribution controlling lens is determined based on the shape of the light incident surface of the light distribution controlling lens (in this example, a sphere with a radius of 50 mm), based on the distance between the LED light source and the light incident surface of the light distribution controlling lens, and based on the refractive index of the material forming the light distribution controlling lens. The angle of incident light at any given point of the light incident surface can be determined by the shape of the light incident surface and the distance between the LED light source and the light incident surface.

By using a design scheme as described in Japanese Patent Application Laid-Open No. 2004-087179 (JP'179) and based on the above-described conditions, the shape of the light-emitting surface can be determined. In the thus designed light distribution controlling lens, the light that has been radially emitted from the LED light source, and which has reached and been refracted at the light incident surface of the light distribution controlling lens, and has been guided through the light distribution controlling lens is refracted at the exit point and the refracted light is directed to a designated direction.

The design scheme disclosed in JP'179 is also described in Applicant's co-pending U.S. patent application Ser. No. 11/248,142 published on Apr. 20, 2006 as U.S. Patent Application Publication No. 2006/0083002, which is hereby incorporated in its entirety by reference.

According to the presently disclosed subject matter, the light-emitting surface has a particular shape so that the emitted light gives a light distribution characteristic for each section of the illumination area and the light distribution characteristic is continuous from one section to the adjacent section.

In other words, the light-emitting surface of the light distribution controlling lens has a shape that refracts light in a designated direction in a continuous manner according to the angle of incidence of the light from the focal point of the light distribution controlling lens.

The optical characteristics of the LED optical module will now be described. The following three types of LED optical modules are considered: a narrow LED optical module having a narrow directivity; a wide LED optical module having a wide directivity; and an intermediate LED optical module having an intermediate directivity between the narrow LED optical module and the wide LED optical module.

Figures 7A, 7B, 7C:
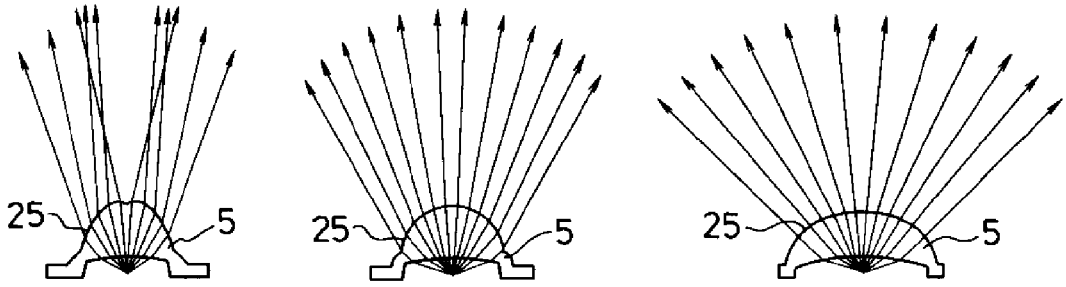
FIG. 7 shows ray-tracing diagrams of different light distribution controlling lenses for an LED optical module.

Now, different light distribution controlling lenses for the respective LED optical modules with different directivities are considered and a beam tracing is performed for each lens (see FIGS. 7A to 7C). Note that each light distribution controlling lens is designed to have a spherical light-emitting surface that is convex forward relative to the LED and has a radius of 50 mm.

As shown in FIGS. 7A to 7C, the curvature of the light-emitting surface 25 of each light distribution controlling lens 5 is correlated to the divergence of light rays emitted from the light-emitting surface 25. Specifically, the rays are diverged to a greater extent as the curvature of the light-emitting surface 25 becomes increasingly small from the lens of FIG. 7A to that of FIG. 7B, and from the lens of FIG. 7B to that of FIG. 7C. Thus, the light distribution controlling lens for the narrow LED optical module preferably has a light-emitting surface consisting primarily of a spherical or aspherical surface with a large curvature or a combination of such surfaces. The light distribution controlling lens for the wide LED optical module preferably has a light-emitting surface consisting primarily of a spherical or aspherical surface with a small curvature or a combination of such surfaces. The light distribution controlling lens for the intermediate LED optical module preferably has a light-emitting surface consisting primarily of a spherical or aspherical surface with an intermediate curvature or a combination of such surfaces.

Figure 8:
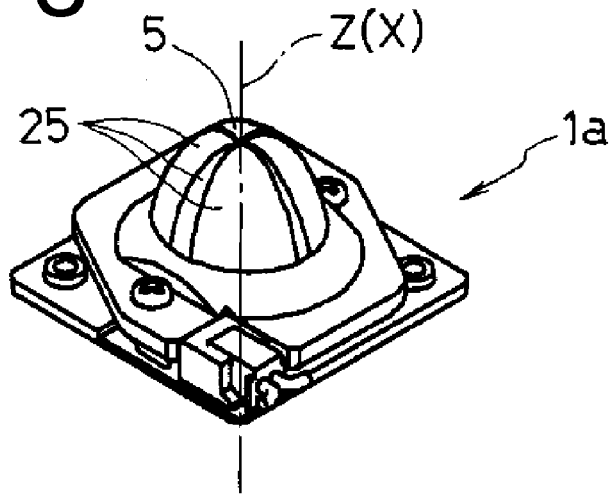
FIG. 8 is a perspective view of a narrow LED optical module.
Figure 9:
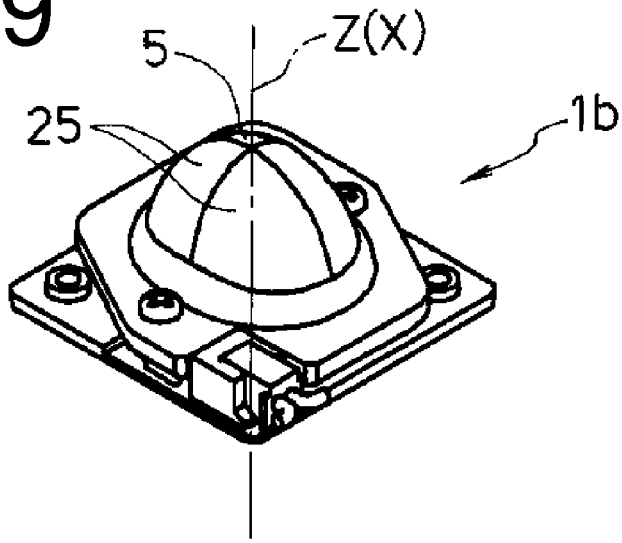
FIG. 9 is a perspective view of an intermediate LED optical module.
Figure 10:
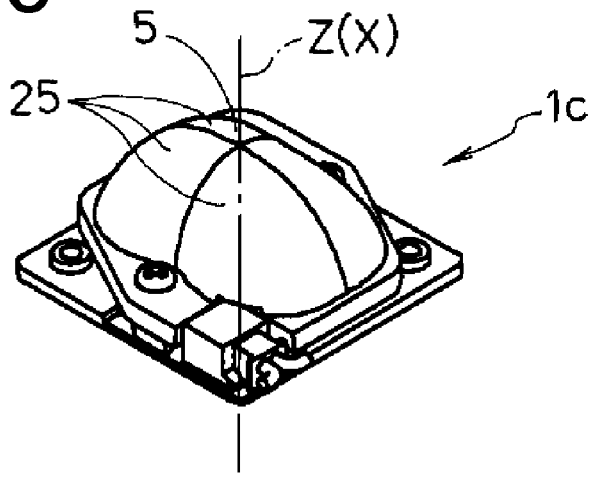
FIG. 10 is a perspective view of a wide LED optical module.

Based on the basic structures of the light distribution controlling lens determined from the results of the ray tracing, three types of LED optical modules were designed as shown in FIGS. 8, 9 and 10, respectively. The three LED optical modules differ from each other only in their light distribution controlling lenses (specifically, the shape of the light-emitting surface of the light distribution controlling lenses).

The LED optical module 1*a* shown in FIG. 8 is a narrow LED optical module. The light distribution controlling lens 5 thereof has a light-emitting surface 25 composed of a plurality of (eight, in this case) continuous free curved surfaces differing in shape. The light-emitting surface 25 has a shape substantially point-symmetrical with respect to the central axis Z of the light distribution controlling lens (or the optical axis X of the LED).

The LED optical module 1*b* shown in FIG. 9 is an intermediate LED optical module. The light distribution controlling lens 5 thereof has a light-emitting surface 25 composed of a plurality of (four, in this case) continuous free curved surfaces differing in shape. The light-emitting surface 25 has a shape substantially point-symmetrical with respect to the central axis Z of the light distribution controlling lens (or the optical axis X of the LED).

The LED optical module 1*b* shown in FIG. 10 is a wide LED optical module. The light distribution controlling lens 5 thereof has a light-emitting surface 25 composed of a plurality of (four, in this case) continuous free curved surfaces differing in shape. The light-emitting surface 25 has a shape substantially point-symmetrical with respect to the central axis Z of the light distribution controlling lens (or the optical axis X of the LED).

When each light distribution controlling lens is cut along a plane that includes the central axis Z of the light distribution controlling lens and extends radially from the central axis, and a light-emitting surface 25 having the largest curvature near the central axis Z are compared with each other in their cross-sections, the curvature of the light-emitting surface increases in the order of the wide LED optical module 1*c* of FIG. 10, the intermediate LED optical module 1*b* of FIG. 9, and the narrow LED optical module 1*a* of FIG. 8.

Figure 11:
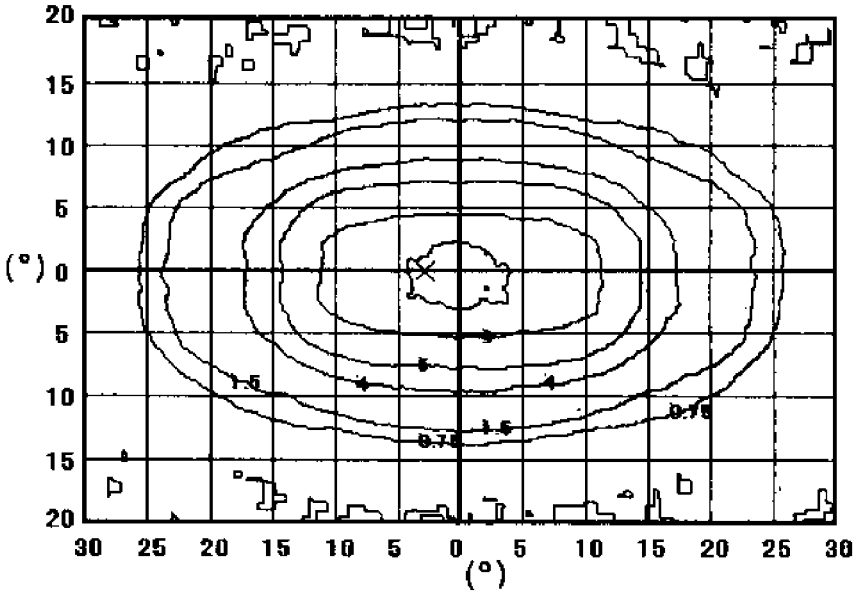
FIG. 11 is a graph showing a light distribution pattern of the narrow LED optical module of FIG. 8.
Figure 12:
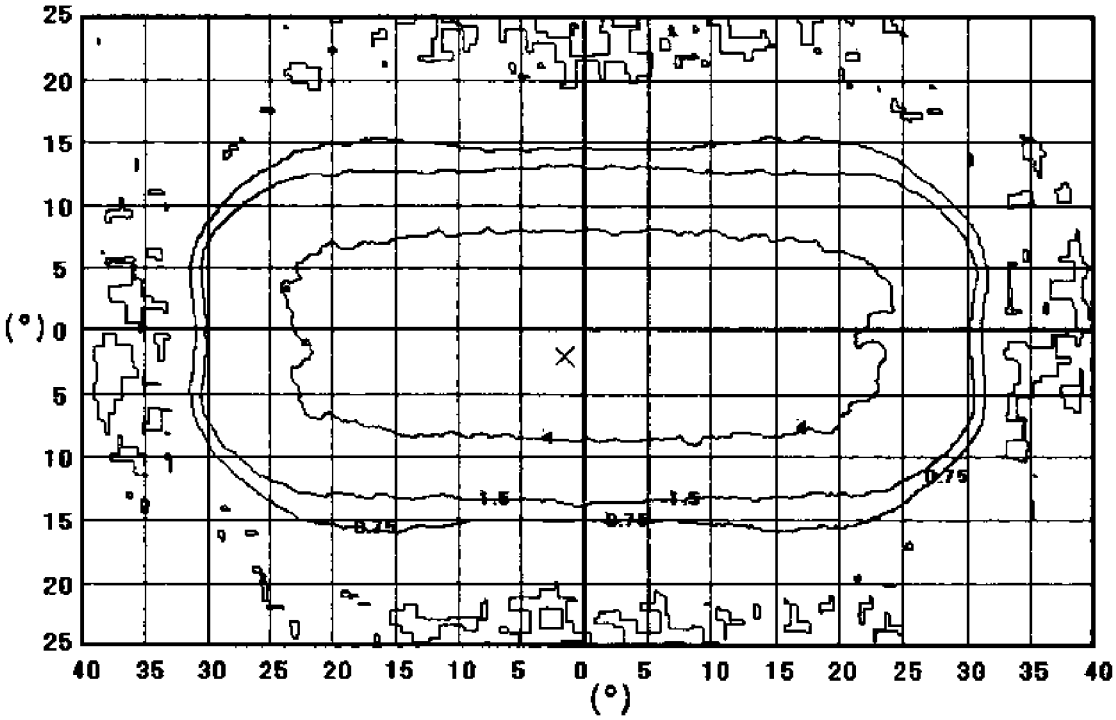
FIG. 12 is a graph showing a light distribution pattern of the intermediate LED optical module of FIG. 9.
Figure 13:
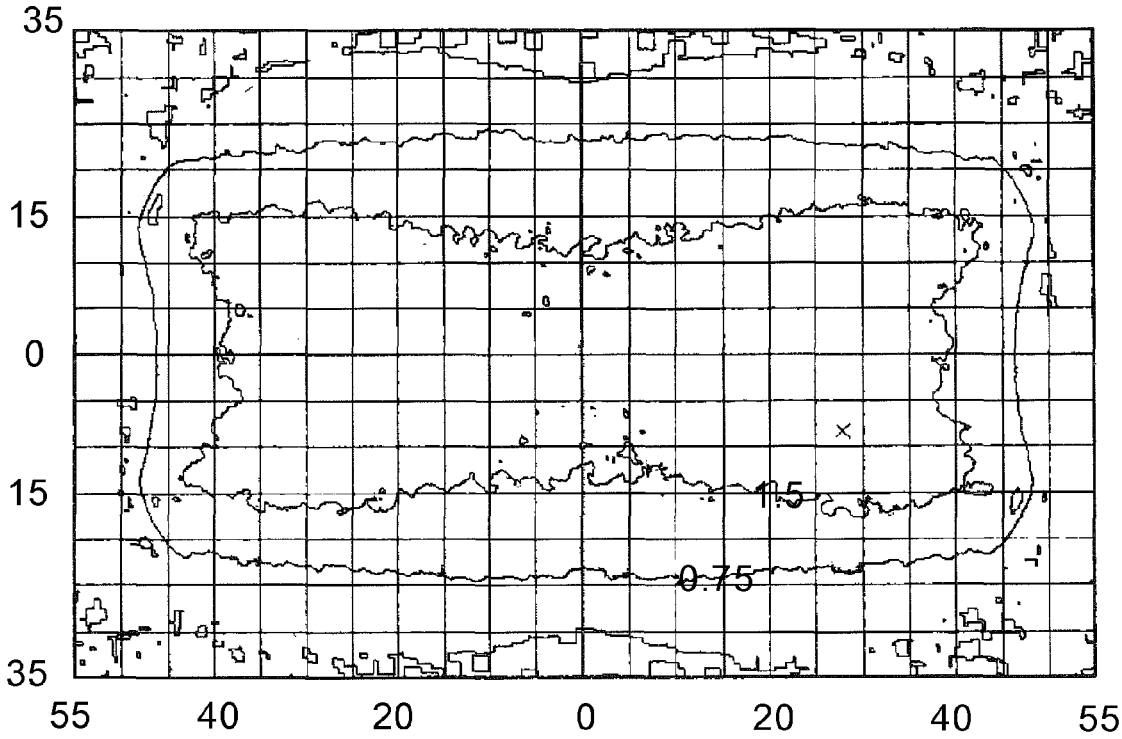
FIG. 13 is a graph showing a light distribution pattern of the wide LED optical module of FIG. 10.

The narrow LED optical module of FIG. 7A shows a light distribution pattern shown in FIG. 11. The intermediate LED optical module of FIG. 7B shows a light distribution pattern shown in FIG. 12. The wide LED optical module of FIG. 7C shows a light distribution pattern shown in FIG. 13. As can be seen from these light distribution patterns, an LED optical module that generates a narrower light distribution pattern has a light-emitting surface with a larger curvature.

Each of the plurality of free curved surfaces with different shapes in each light distribution controlling lens emits light that provides a light distribution characteristic for one of the plurality of sections defined in the area illuminated by the LED optical module. Thus, the number of the plurality of continuous free curved surfaces with different shapes that form the light-emitting surface of light distribution controlling surface of each LED optical module is the same as the number of the plurality of sections defined in the area illuminated by the LED optical module.

While these three types of LED optical modules may be used individually, a plurality of modules of the same type or different types may be combined to construct an LED optical unit according to a desired specification for an LED lighting fixture(s) (for example, illumination, area to be illuminated, and the like).

Figure 14:
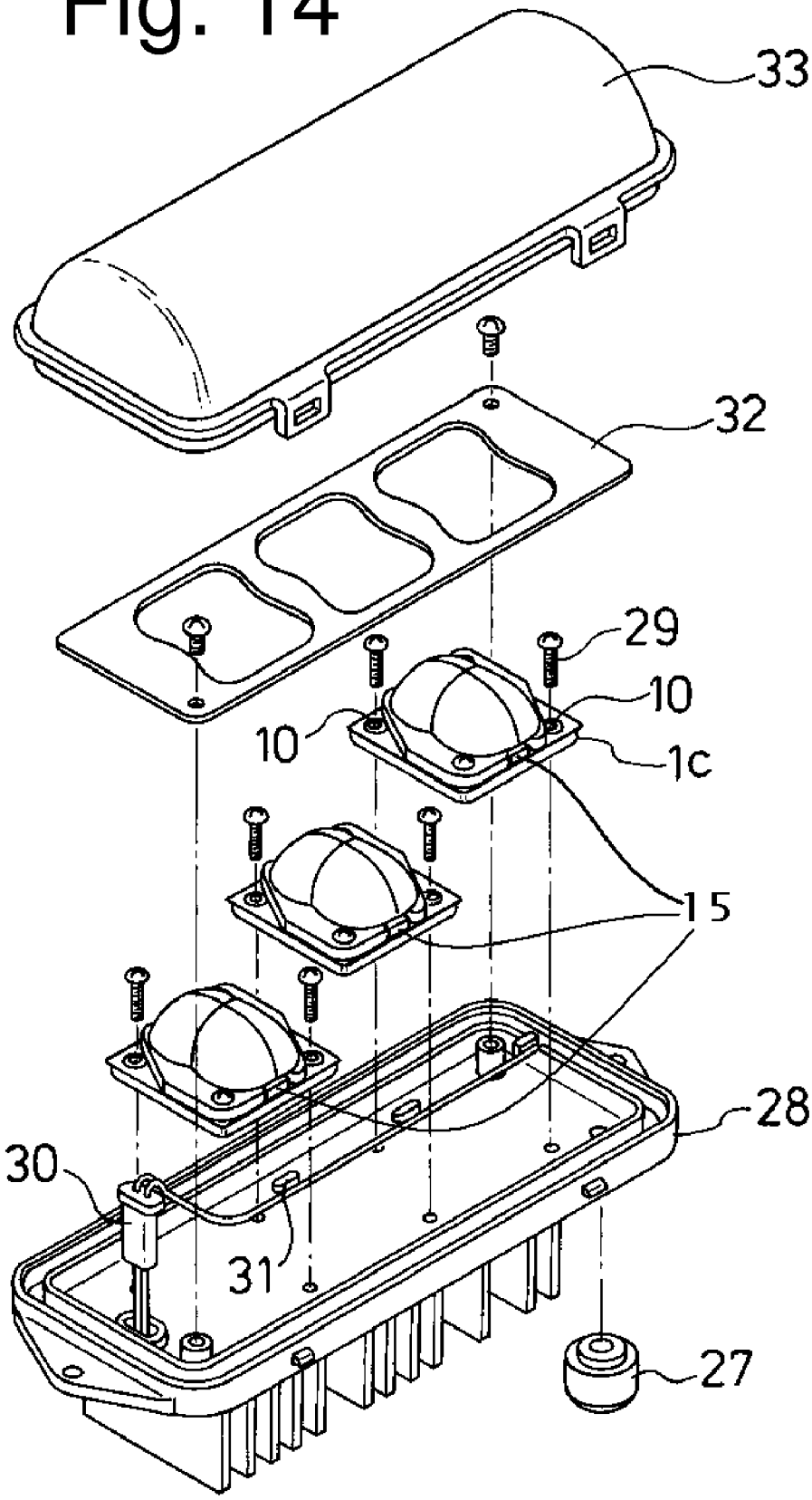
FIG. 14 is an exploded perspective view of an exemplary LED optical unit made in accordance with principles of the disclosed subject matter.
Figure 15:
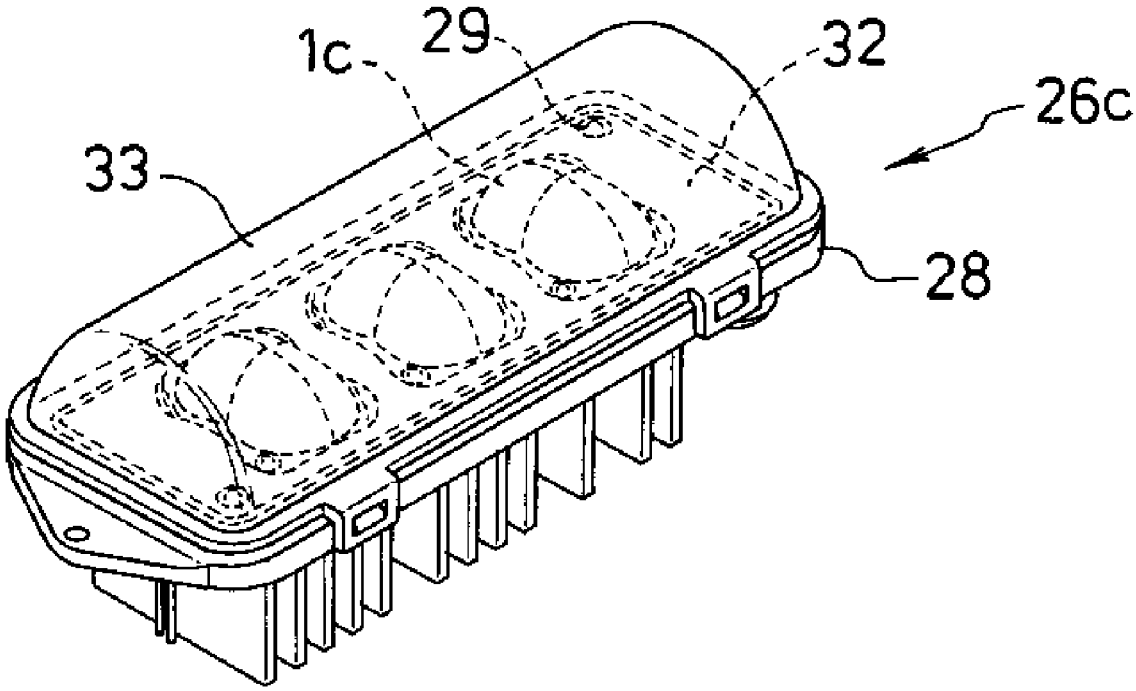
FIG. 15 is a perspective view of the LED optical unit of FIG. 14.

FIG. 14 is an exploded perspective view showing a wide LED optical unit 26*c* comprising three wide LED optical modules 1*c*, and FIG. 15 is a perspective view thereof. The LED optical unit 26*c* is configured such that the three wide LED optical modules 1*c* are mounted on a housing 28 that has radiator fins and a waterproof cap 27 attached at the bottom thereof. A heat-conductive plate (not shown) is placed between each LED optical module 1*c* and the housing 28. Each LED optical module 1*c* is secured to the housing 28 by passing the shank of a securing screw 29 through a screw bore 10 of the wide LED optical module 1*c* and screwing it into a corresponding screw bore formed on the housing 28.

An external connector 30 is also mounted on the housing 28 for providing the unit with electrical power from an external power supply. An electrical cord connects the external connector 30 to a wire connector 31, which in turn is connected to a board connector 15 on the wide LED optical module 1*c*.

An extension 32 is placed to cover areas other than the wide LED optical module 1*c* and an outer lens 33 is secured to the housing 28 to complete the wide LED optical unit 26*c*.

The housing 28 is formed of a good heat conductor and may be an aluminum die-cast housing.

It is contemplated that an intermediate LED optical unit can include three intermediate LED optical modules 1*b* and can be provided along with a narrow LED optical unit which includes three narrow LED optical modules 1*a* as described above. In addition, any combination of LED optical units can be provided depending on a particular application. For example, the wide LED optical unit 26*c* as described above can be combined with narrow and/or intermediate LED optical units as described above.

Figure 16:
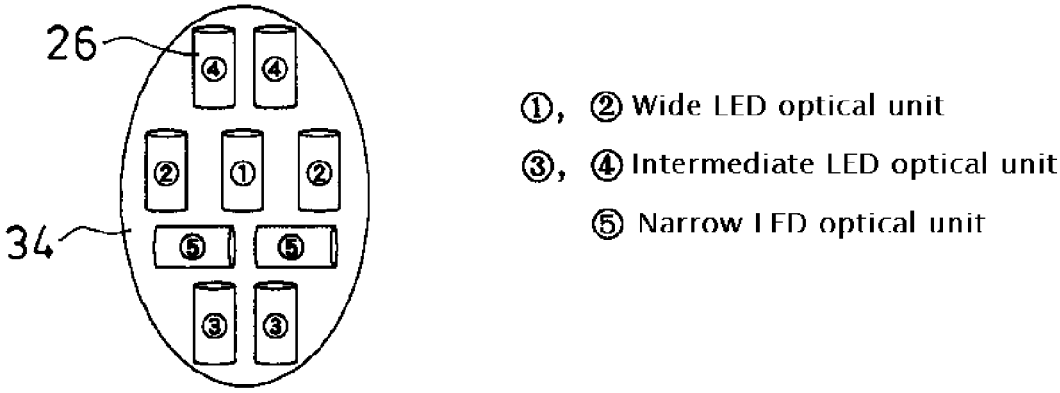
FIG. 16 is a schematic front view of an exemplary LED lighting fixture made in accordance with principles of the disclosed subject matter.
Figure 17:
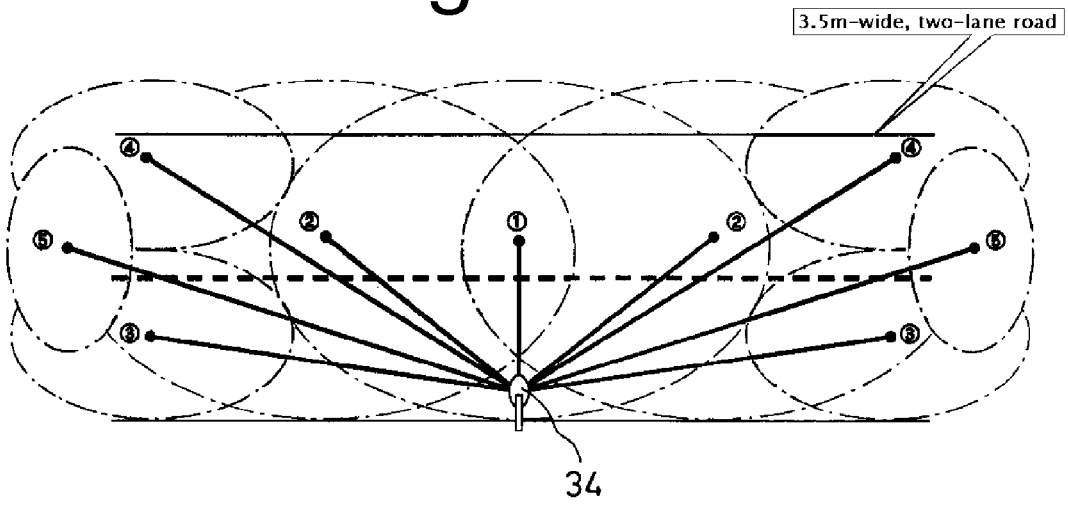
FIG. 17 is a schematic diagram showing areas illuminated by individual LED optical units of the LED lighting fixture of FIG. 16.

A total of nine LED optical units 26 (two narrow LED optical units, four intermediate LED optical units and three wide LED optical units) are arranged as shown in FIG. 16 to construct an LED lighting fixture 34. As shown in FIG. 17, this arrangement is intended to illuminate a 3.5 m-wide, two-lane road with each LED optical unit 26 assigned an area of the road to be illuminated. The light distribution pattern generated by the LED lighting fixture 34 can be determined by a simulation as shown in FIG. 18.

Figure 18:
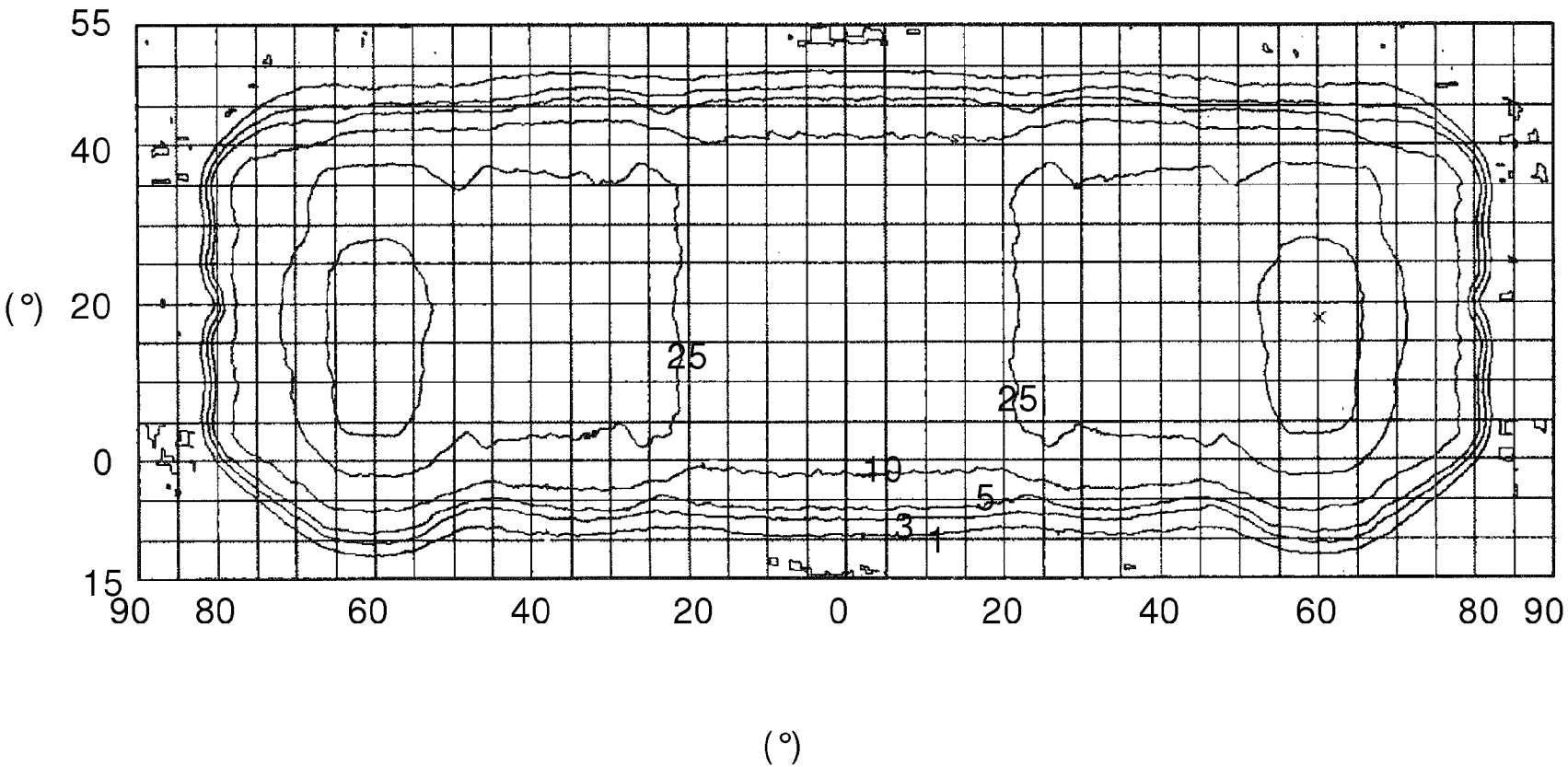
FIG. 18 is a graph showing a light distribution pattern of the LED lighting fixture of FIG. 16.

FIG. 18 shows that the LED lighting fixture 34 illuminates the intended area with little deviation in brightness, indicating that the respective areas illuminated by the respective LED optical units 26 are effectively arranged.

Figure 19:
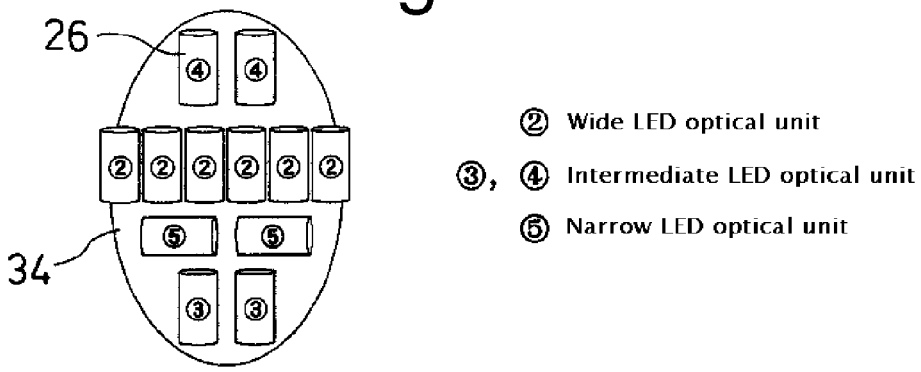
FIG. 19 is a schematic front view of another exemplary LED lighting fixture made in accordance with principles of the disclosed subject matter.
Figure 20:
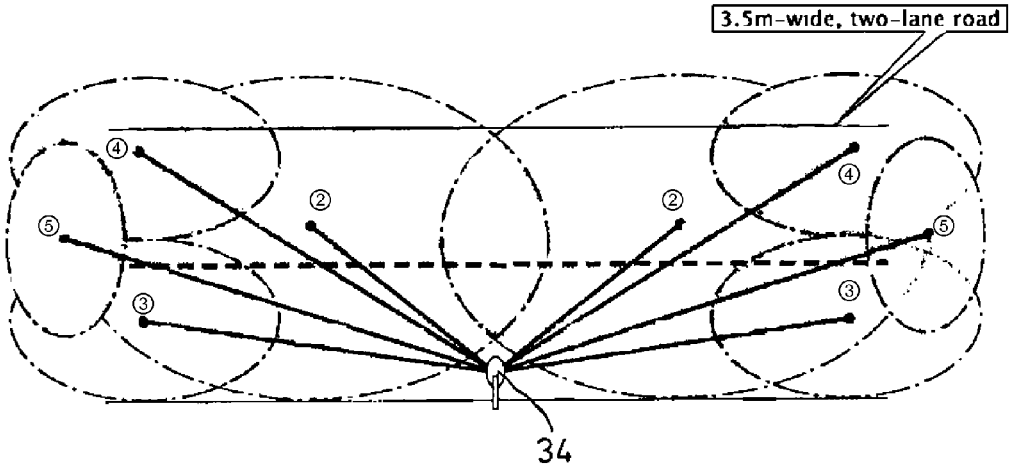
FIG. 20 is a schematic diagram showing areas illuminated by individual LED optical units of the LED lighting fixture of FIG. 19.

A total of 12 LED optical units 26 (two narrow LED optical units, four intermediate LED optical units and six wide LED optical units) are arranged as shown in FIG. 19 to construct an LED lighting fixture 34. As shown in FIG. 20, this arrangement is intended to illuminate a 3.5 m-wide, two-lane road with each LED optical unit 26 assigned an area of the road to be illuminated. The light distribution pattern generated by the LED lighting fixture can be determined by simulation as shown in FIG. 21.

Figure 21:
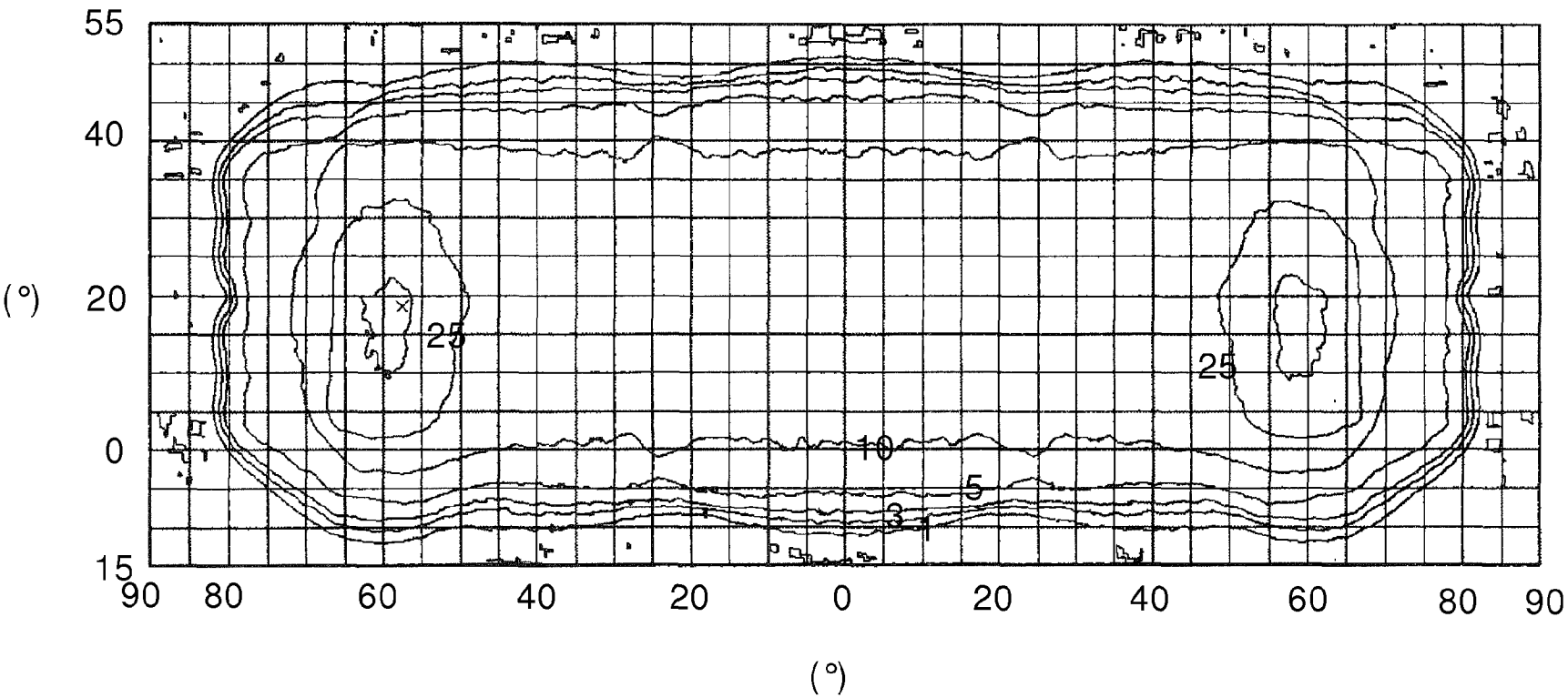
FIG. 21 is a graph showing a light distribution pattern of the LED lighting fixture of FIG. 19.

FIG. 21 shows that the LED lighting fixture illuminates the intended area with little deviation in brightness, indicating that the respective areas illuminated by the plurality of LED optical units 26, which are effectively arranged. Using three more wide LED optical units than the LED lighting fixture of FIG. 16, this example achieves higher brightness substantially in the entire illumination area.

Figure 22:
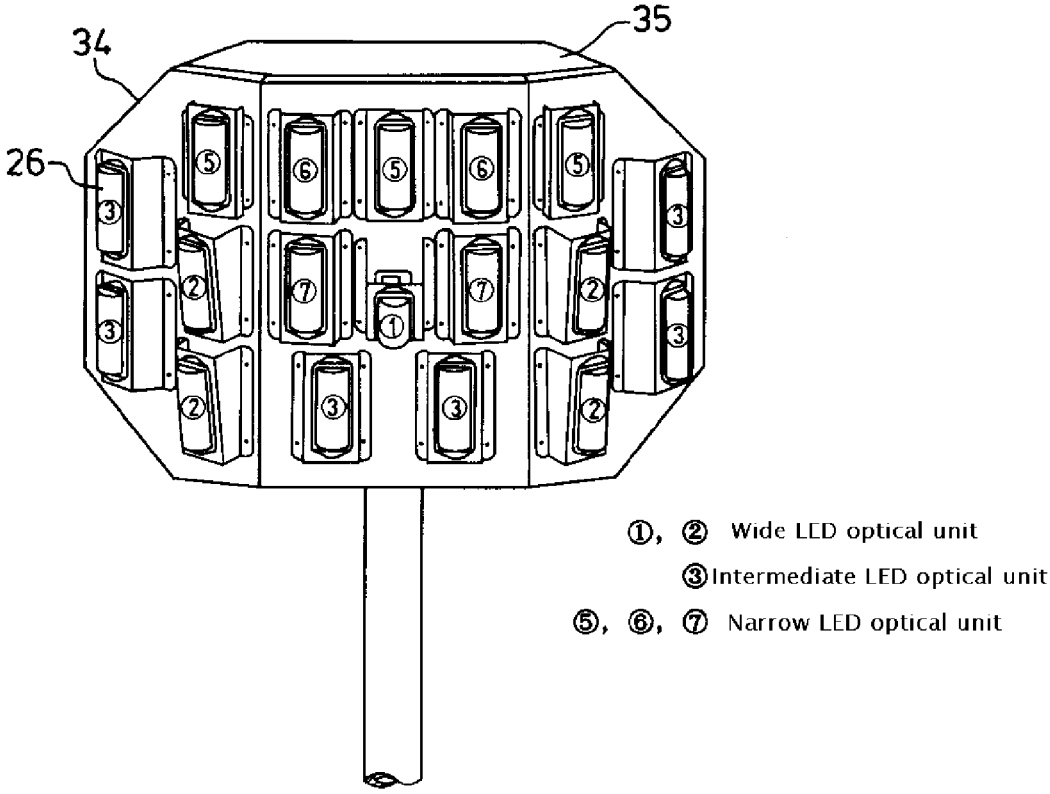
FIG. 22 is a front view of another exemplary LED lighting fixture made in accordance with principles of the disclosed subject matter.
Figure 23:
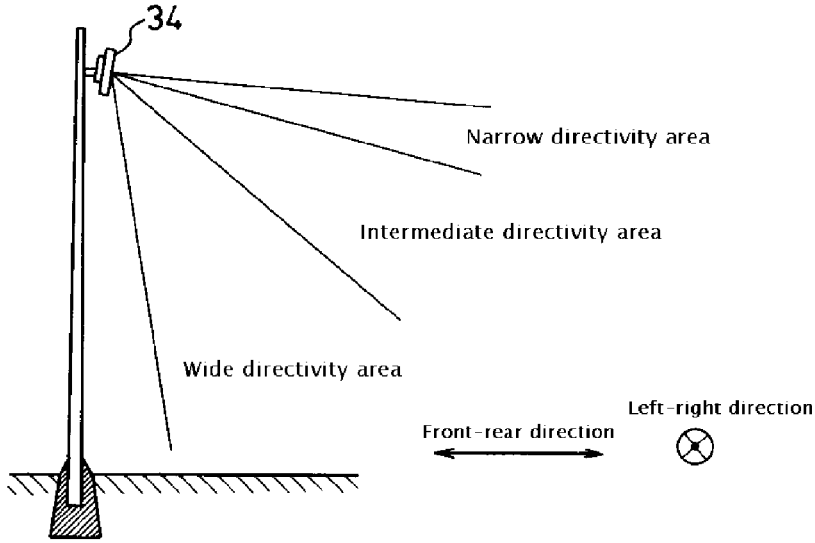
FIG. 23 is a schematic diagram showing installation of an LED lighting fixture made in accordance with principles of the disclosed subject matter.

As shown in FIG. 22, a total of 18 LED optical units 26 (seven narrow LED optical units, six intermediate LED optical units, and five wide LED optical units) are attached to a three-sided panel 35 that is bent at a predetermined angle to construct an LED lighting fixture 34. As shown in FIG. 23, the LED lighting fixture 34 can be placed at a specific height above the surface to be illuminated and at a specific angle to the surface.

Of all the LED optical units 26 that constitute the lighting fixture 34, the area relatively close to the LED lighting fixture 34 (wide directivity area) is mainly covered by wide LED optical units 26, the area relatively distant from the LED lighting fixture 34 (narrow directivity area) is mainly covered by narrow LED optical units 26, and the intermediate area (intermediate directivity area) is mainly covered by intermediate LED optical units 26.

When it is desired to extend the illumination area or to achieve uniform brightness throughout the illumination area, the LED optical units 26 may be attached at an angle to the mounting face of the panel 35. As can be seen from FIG. 22, some of the LED optical units 26 are attached at an angle to the mounting face of the panel 35 in this example.

Figure 24:
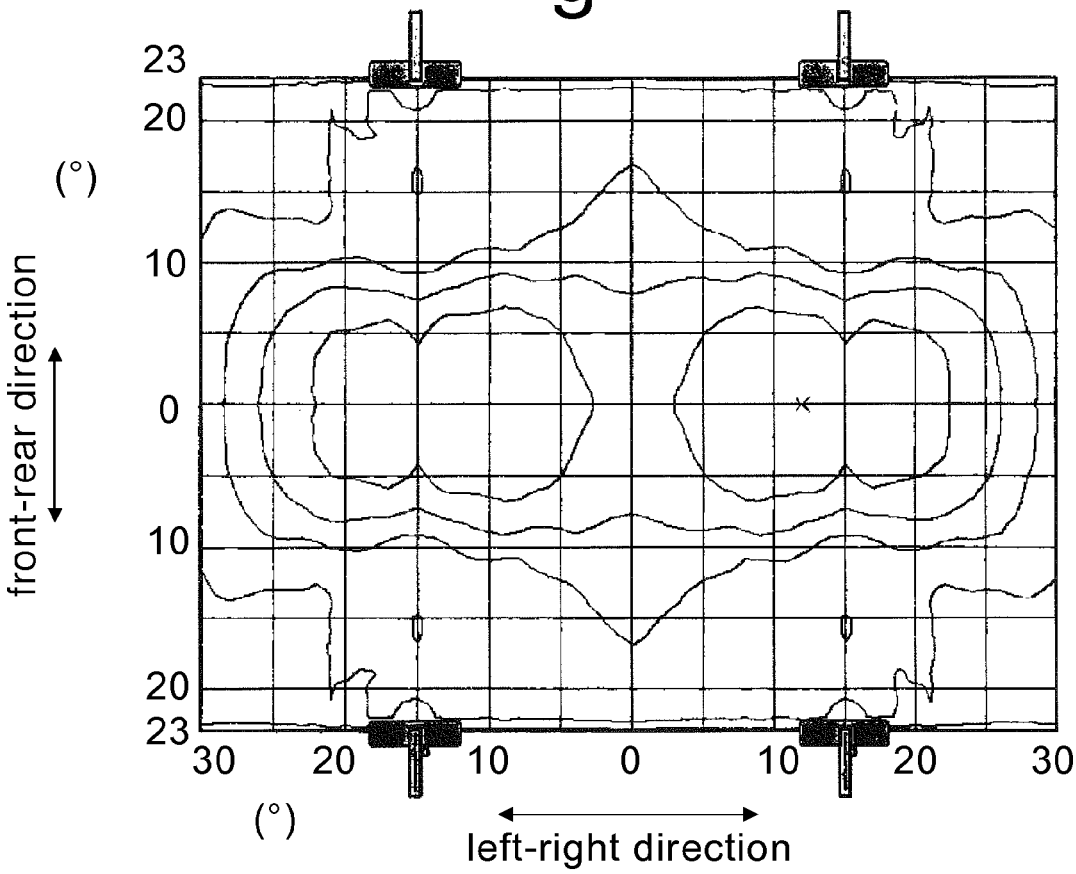
FIG. 24 is a graph showing a light distribution pattern of the LED lighting fixture of FIG. 22.

FIG. 24 shows a light distribution pattern generated by an LED lighting fixture 34 of FIG. 22. It can be seen that the area 30 degrees left or right and 23 degrees front or rear of the center of the illumination area is illuminated in a well-balanced manner. The LED lighting fixture having such a light distribution pattern is particularly effective when used as a lighting fixture to uniformly illuminate a wide area at high brightness. One example is a lighting fixture used to illuminate stadiums during night games.

As set forth, an LED light source and a light distribution controlling lens form an optical system for use in the LED optical module used in the LED lighting fixture of the presently disclosed subject matter. This construction eliminates the need to use a reflector that directs the light from the light source to a desired direction, which leads to advantages such as reduction in the number of parts, reduced need for high assembly precision, a reduction in the weight of the lighting fixture, etc.

The spherical light incident surface of the light distribution controlling lens encircles the LED light source and serves to increase the ratio of the amount of light that travels through the light incident surface into the light distribution controlling lens to the amount of light emitted radially from the LED light source and reaching the light incident surface. As a result, effective use of light is achieved.

In the LED optical module in accordance with the presently disclosed subject matter, the light-emitting surface of the light distribution controlling lens can be composed of a plurality of continuous free curved surfaces differing in shape so that the light emitted from each free curved surface provides a light distribution characteristic for each of the plurality of sections defined in an illumination area. This construction enables detailed setting of the light distribution characteristics of the LED optical module and, thus, significantly increases the degree of freedom in the design of light distribution characteristics.

In accordance with the presently disclosed subject matter, different types of LED optical modules having different light distribution characteristics can be constructed by replacing the light distribution controlling lens, and a plurality of LED optical modules having the same or different light distribution characteristics are combined to construct an LED optical unit. Such an LED optical unit can provide a greater amount of illumination light than the individual modules. Similar to a single LED optical module, this construction also enables detailed setting of the light distribution characteristics of the LED optical unit and, thus, significantly increases the degree of freedom in designing light distribution characteristics.

According to the presently disclosed subject matter, a plurality of LED optical units having the same or different light distribution characteristics are combined to construct an LED lighting fixture. In this construction, each of the plurality of sections defined in a large illumination area can be assigned particular light distribution characteristics by a particular LED optical unit. Not only does this construction make it possible, as is the case with the LED optical unit, to set the light distribution characteristics of the LED lighting fixture over a large illumination area in a detailed manner, it also ensures uniform brightness throughout the illumination area. Thus, the degree of freedom in designing light distribution characteristics is significantly improved.

Furthermore, an LED lighting fixture in accordance with the presently disclosed subject matter can be designed to have a functional and substantially three-dimensional appearance, rather than a simple bulbous design.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents. All related art references described above are hereby incorporated in their entirety by reference.

What is claimed is:

1. An LED lighting fixture comprising:

a set of LED optical units having different light distribution characteristics, respectively, and each of the LED optical units including two or more LED optical modules configured to emit light forming a corresponding light distribution characteristic, each LED optical module including an LED serving as a light source and at least one light distribution controlling lens located in an illumination direction of the LED light source, wherein the LED optical modules includes a first LED optical module mounted to a first LED optical unit, the first LED optical module configured to form a first light distribution characteristic, and the LED optical modules also includes a second LED optical module mounted to a second LED optical unit, the second LED optical module configured to form a second light distribution characteristic, wherein the first light distribution characteristic and the second light distribution characteristic are different from each other, and wherein each of the LED optical modules mounted to the same LED optical unit has the same light distribution characteristics with respect to each other and wherein the LED optical modules mounted to the different LED optical units have different light distribution characteristics with respect to each other.

2. The LED lighting fixture according to claim 1, wherein the LED optical units are configured in such a manner that a portion of an area to be illuminated by the LED lighting fixture and located at a first position close to the LED lighting fixture is illuminated by the first LED optical unit having a wide light distribution characteristic when the lighting fixture is operated, and a portion of the area that is located at a second position further from the lighting fixture as compared to the first position is illuminated when the lighting fixture is operated by the second LED optical unit having a narrow light distribution characteristic as compared to the wide light distribution characteristic of the first LED optical unit.

3. The LED lighting fixture according to claim 2, wherein the light distribution controlling lens includes an incident surface upon which light from the LED is incident and a light-emitting surface from which the light is emitted from the controlling lens to an area outside of the controlling lens, the incident surface and the light-emitting surface both being curved in the illumination direction relative to the LED to form a substantially convex profile;

the light distribution controlling lens has a focal point substantially at the LED; and the light-emitting surface includes a plurality of continuous free curved surfaces differing in shape.

4. The LED lighting fixture according to claim 3, wherein the light-emitting surface of the light distribution controlling lens has a shape that refracts light in a designated direction in a continuous manner according to an incident angle of the light from the focal point of the light distribution controlling lens.

5. The LED lighting fixture according to claim 1, wherein the light distribution controlling lens includes an incident surface upon which light from the LED is incident and a light-emitting surface from which the light is emitted from the controlling lens to an area outside of the controlling lens, the incident surface and the light-emitting surface both being curved in the illumination direction relative to the LED to form a substantially convex profile;

the light distribution controlling lens has a focal point substantially at the LED; and the light-emitting surface includes a plurality of continuous free curved surfaces differing in shape.

6. The LED lighting fixture according to claim 5, wherein the light-emitting surface of the light distribution controlling lens has a shape that refracts light in a designated direction in a continuous manner according to an incident angle of the light from the focal point of the light distribution controlling lens.

7. The LED lighting fixture according to claim 1, wherein the controlling lens of the LED optical modules includes a first light distribution controlling lens and a second light distribution controlling lens, and the first light distribution controlling lens is shaped differently from the second light distribution controlling lens.

8. An LED lighting fixture comprising:

at least one first LED optical unit including a first housing and at least one first LED optical module located in the first housing and configured to emit light forming a first light characteristic; and at least one secondary LED optical unit including a secondary housing and at least one secondary LED optical module located in the secondary housing and configured to emit light forming a secondary light characteristic, the secondary light characteristic being different from the first light characteristic, wherein the at least one first LED optical module includes a first LED serving as a first light source and includes a first light characteristic controlling lens located in an illumination direction of the first LED light source, and the at least one secondary LED optical module includes a secondary LED serving as a secondary light source and includes a secondary light characteristic controlling lens located in an illumination direction of the secondary LED light source, the secondary light characteristic controlling lens being shaped differently from the first light characteristic controlling lens, wherein each of the LED optical modules mounted to the same LED optical unit has the same light distribution characteristics with respect to each other and wherein the LED optical modules mounted to the different LED optical units have different light distribution characteristics with respect to each other.

9. The LED lighting fixture according to claim 8, wherein the at least one first LED optical module includes a plurality of first LED optical modules, and the at least one secondary LED optical module includes a plurality of secondary LED optical modules.

10. The LED lighting fixture according to claim 8, wherein the at least one first LED optical unit is configured to emit light having a wide light distribution characteristic towards a first area close to the LED light fixture, and the at least one secondary LED optical unit is configured to emit light having a narrow light distribution characteristic towards a secondary area located further from the LED light fixture than the first area.

11. The LED lighting fixture according to claim 8, wherein the first light characteristic controlling lens includes a first incident surface upon which light from the first LED is incident and a first light-emitting surface from which light is emitted from the first controlling lens to an area outside of the first controlling lens, the first light-emitting surface being curved in an illumination direction relative to the first LED to form a substantially convex surface facing away from the first LED.

12. The LED lighting fixture according to claim 11, wherein the first light characteristic controlling lens has a first focal point substantially at the first LED; and the first light-emitting surface includes a plurality of continuous free curved surfaces differing in shape.

13. The LED lighting fixture according to claim 12, wherein the first light-emitting surface of the first light characteristic controlling lens has a shape that refracts light in a designated direction in a continuous manner according to an incident angle of light from the first focal point of the first light characteristic controlling lens.

14. The LED lighting fixture according to claim 11, wherein the secondary light characteristic controlling lens includes a secondary incident surface upon which light from the secondary LED is incident and a secondary light-emitting surface from which light is emitted from the secondary controlling lens to an area outside of the secondary controlling lens, the secondary light-emitting surface being curved in an illumination direction relative to the secondary LED to form a substantially convex surface facing away from the secondary LED.

15. The LED lighting fixture according to claim 14, wherein the secondary light characteristic controlling lens has a secondary focal point substantially at the secondary LED; and the secondary light-emitting surface includes a plurality of continuous free curved surfaces differing in shape.

16. The LED lighting fixture according to claim 15, wherein the secondary light-emitting surface of the secondary light characteristic controlling lens has a secondary shape that refracts light in a secondary designated direction in a continuous manner according to an incident angle of light from the secondary focal point of the secondary light characteristic controlling lens.

17. The LED lighting fixture according to claim 8, wherein the first light characteristic is a first light distribution pattern and the secondary light characteristic is a secondary light distribution pattern.

18. An LED lighting fixture comprising:

a set of LED optical units having different light distribution characteristics, respectively, and each of the LED optical units including two or more LED optical modules configured to emit light forming a corresponding light distribution characteristic, each of the LED optical modules including an LED serving as a light source and a light distribution controlling lens arranged in an illumination direction of the LED light source, wherein each of the LED optical modules mounted to the same LED optical unit is of the same type with respect to each other and wherein the LED optical modules mounted to different LED optical units are a different type with respect to each other.

* * * * *